US005332131A

United States Patent [19]

Pehr

[11] Patent Number: 5,332,131

[45] Date of Patent: Jul. 26, 1994

[54] KICKER LATCH FOR CONTAINER CLOSURES

[76] Inventor: Harold T. Pehr, 3920 W. 96th St., Shawnee Mission, Kans. 66207

[21] Appl. No.: 951,877

[22] Filed: Sep. 28, 1992

[51] Int. Cl.[5] ..... B67D 5/00

[52] U.S. Cl. ..... 222/505; 222/528; 222/532; 222/536; 222/556; 220/326; 215/237

[58] Field of Search ..... 222/153, 505, 508, 509, 222/526-538, 556; 215/237, 245, 216, 225; 220/324, 326

[56] References Cited

U.S. PATENT DOCUMENTS

| | | | |
|---|---|---|---|
| 3,655,099 | 4/1972 | Hazard | 222/153 |
| 3,718,238 | 2/1973 | Hazard et al. | 222/536 |
| 3,863,818 | 2/1975 | Hazard | 222/531 |
| 3,874,568 | 4/1975 | LaVange et al. | 222/505 |
| 3,881,643 | 5/1975 | La Vange | 222/505 |
| 3,884,392 | 5/1975 | Hazard | 222/153 |
| 3,907,179 | 9/1975 | Pehr | 222/513 |
| 4,209,100 | 6/1980 | Uhlig | 215/237 X |
| 4,440,327 | 4/1984 | Dark | 222/530 |
| 4,533,058 | 8/1985 | Uhlig | 222/153 X |
| 4,940,167 | 7/1990 | Fillmore et al. | 222/153 |

FOREIGN PATENT DOCUMENTS

| | | | |
|---|---|---|---|
| 16188 | 10/1889 | United Kingdom | 222/508 |

*Primary Examiner*—Andres Kashnikow
*Assistant Examiner*—Anthoula Pomrening
*Attorney, Agent, or Firm*—Litman, McMahon & Brown

[57] ABSTRACT

A kicker latch for container closures includes a latch wall integrally hinged to the cap and having a latch tab extending from an end of the latch wall toward the cap and kicker lever extending in generally the same direction and spaced from the latch tab. In general, pivoting the kicker latch outwardly causes the kicker lever to urge a closure member of the cap away from its closed position to facilitate grasping the closure member to pivot it to its fully open position. On a folding spout type of cap, wherein the folding spout functions as a closure member, the latch wall may include a plug positioned between the latch tab and the kicker lever to seal the end of the spout. In general, the kicker latch has utility with a variety of types of container closures, including caps with nonfolding spouts, open top types of caps for pills and granulates, and containers for which the closure member is a lid which is completely separable from the container.

26 Claims, 4 Drawing Sheets

Fig.8.
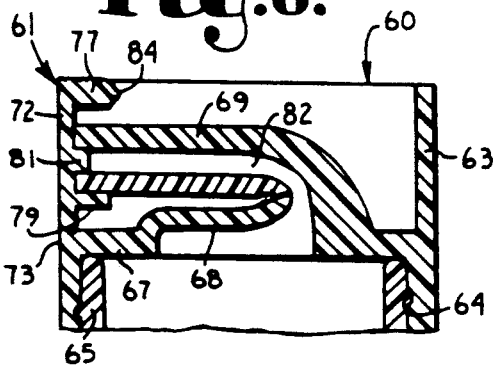
Fig.9.
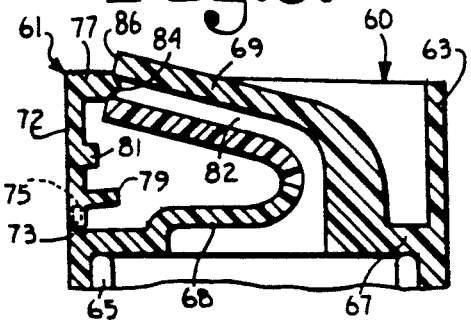
Fig.10.
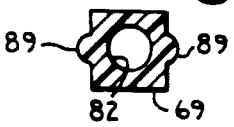
Fig.11.
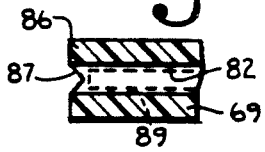
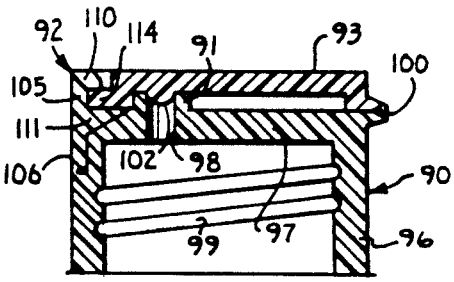
Fig.12.
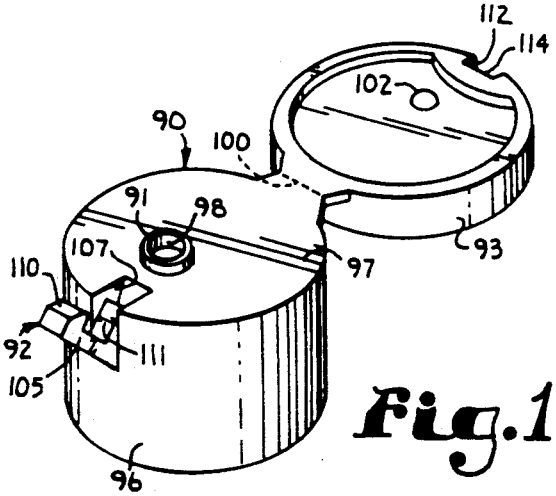
Fig.13.
Fig.14.
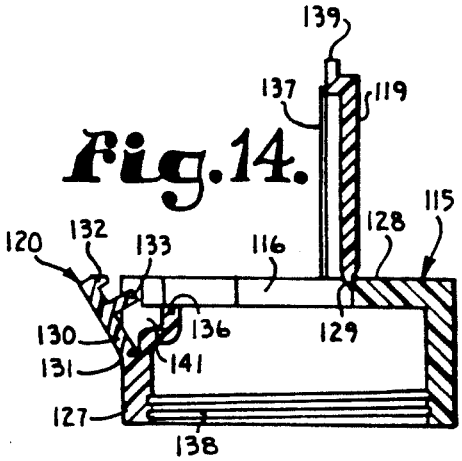
Fig.15.
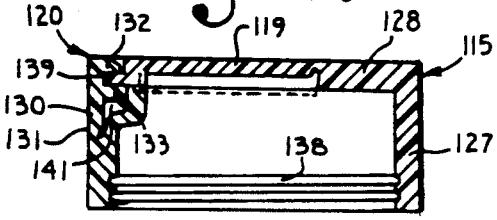

Fig.16.
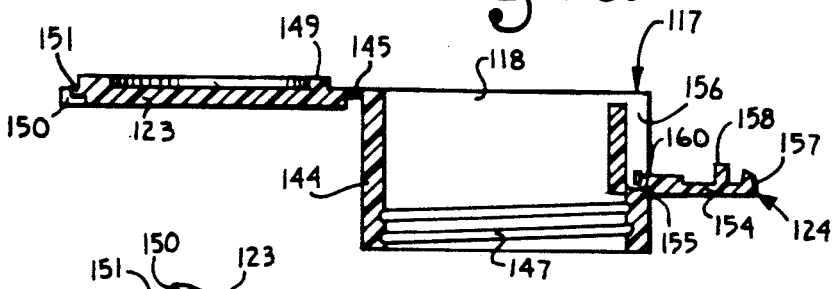
Fig.17.
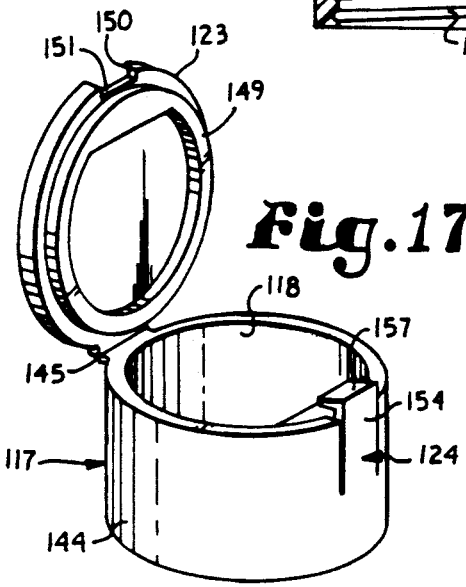
Fig.18.
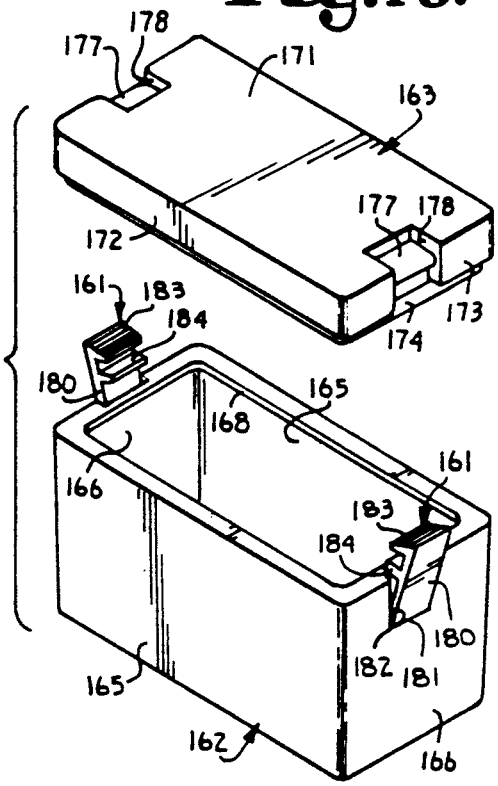
Fig.19.
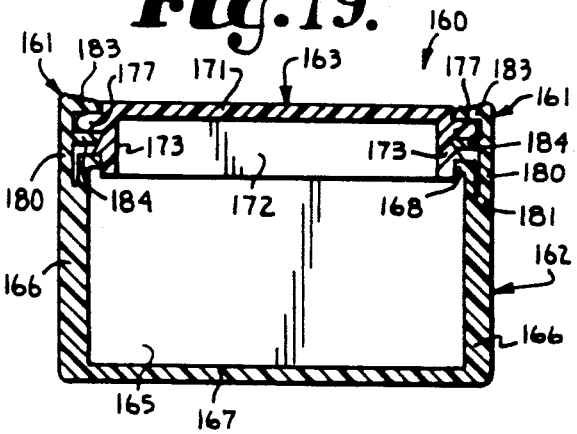
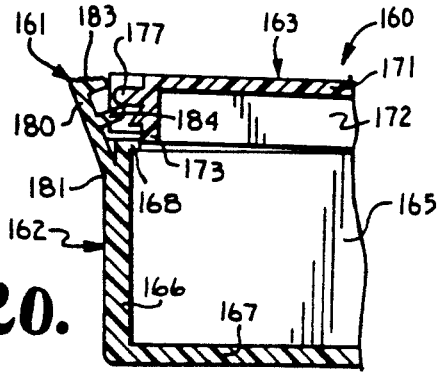
Fig.20.

Fig. 21.
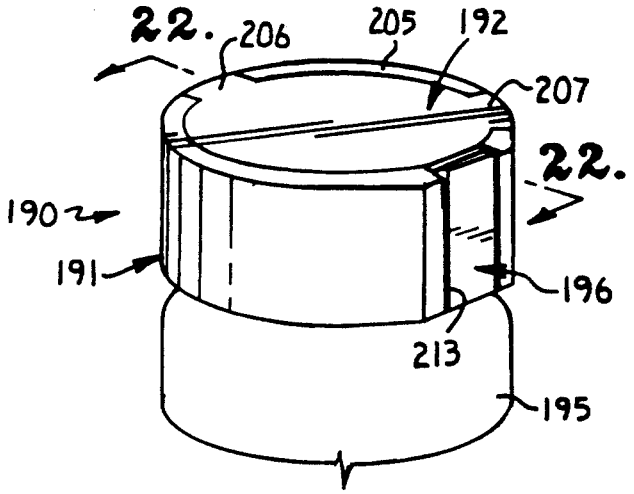
Fig. 22.
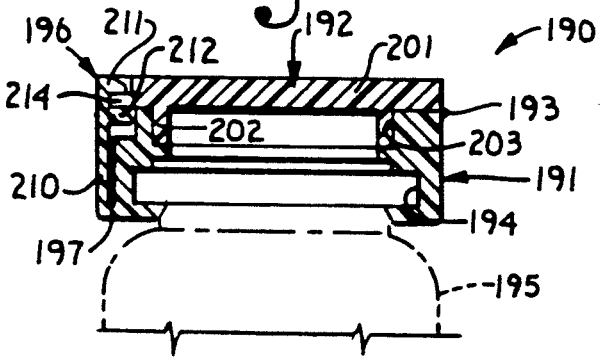
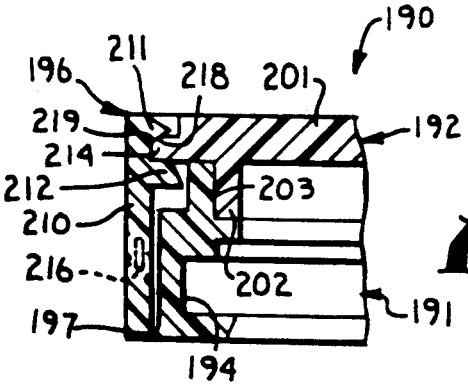
Fig. 23.

KICKER LATCH FOR CONTAINER CLOSURES

BACKGROUND OF THE INVENTION

There are a great variety of molded caps for closing various types of bottles, vials, and other containers. Many incorporate a hinged closure member for selectively enabling access to the contents of the container or preventing such access so that removal of the cap is not necessary. Dispensing bottles which contain liquid or semi-liquid materials require a closure which seals the liquid within the bottle to prevent leakage. The requirement for sealing necessitates tight interfitting members of the caps which, in turn, means that the closure members are difficult to open. Heretofore, attempts to open such caps have often resulted in broken fingernails, pinched fingers, and frustration. Caps for containers of non-liquid materials, such as pills and granulates have suffered from similar problems.

Liquid and semi-liquid materials, such as pharmaceuticals, condiments, cosmetics, and the like are often marketed in squeeze or squirt containers having spouts which pivot to close and seal the container. There are a number of existing spouted caps which are formed as two pieces, a separate spout which is pivoted within a cap body, the spout passage aligning with a passage in the cap when the spout is opened fully. Such designs are generally effective in sealing the contents when closed and are generally convenient to open and close. However, the need to manufacture and assemble two parts having tight enough tolerances to seal a liquid in the container results in a cap which is relatively expensive. Since most such containers and caps are not reusable and are normally discarded when the contents are exhausted, it is desirable for such caps to be as inexpensive as possible, commensurate with effective sealing and convenient operation.

One-piece spouted caps have been developed in which the spout is connected to the cap body by a flexible diaphragm and/or a bellows which allow the cap to seal when the spout is folded down into the body of the cap. The spout may be sealed at the outer end by a plug formation on a cylindrical wall of the cap body, by a seal boss at an inner end which is engaged by a portion of the diaphragm when the spout is folded closed, or by both. Because of the tightness of fit needed for an effective seal in the closed position, the caps of this type have been very difficult to open and to close.

Other types of caps, such as for squirt containers, containers for pills and granulates, and the like, may also be difficult to operate, particularly when tightness of fit for sealing the container is necessary.

SUMMARY OF THE INVENTION

The present invention provides a folding spout cap which has the economic advantages of a one-piece design and which seals effectively but is more convenient to open and close than existing caps of this type. The folding spout cap of the present invention incorporates a kicker latch which retains the spout in a folded or closed position and, when pivoted outwardly, urges the spout well past the closed position toward its open position whereby the spout can be conveniently grasped and pivoted to a fully open position. Besides folding spout caps, the kicker latch of the present invention is advantageously applicable to other types of caps and closures.

The folding spout cap of the present invention includes a cylindrical cap housing or body formed by a hollow cylindrical housing wall with a spout connected by a bellows to a diaphragm which closes the hollow cylindrical housing. The kicker latch includes a latch wall integrally hinged to the housing wall at a latch opening into which the latch wall fits. A latch tab extends inwardly at an end of the latch wall, and a kicker lever extends inwardly at a position spaced from the latch tab. A spout end plug may be formed on the inner surface of the latch wall between the latch tab and the kicker lever. The side edges of the latch wall and the edges of the cylindrical wall at the latch opening are provided with cooperating snap bumps and grooves to hold the latch tab in place in the latch opening. The latch wall may be scored between the kicker lever and the hinge area to increase the flexibility of the portion of the latch wall having the latch tab and the kicker thereon.

To close the folding spout cap, the spout is folded down, and the kicker latch is pivoted toward the spout to position the outer end of the spout between the latch tab and the kicker lever, with the plug in the end of the spout to seal the spout passage. The latch tab retains the spout in its closed position and prevents it from being inadvertently opened. When access to the contents of the container is desired, the kicker latch is pivoted outwardly, withdrawing the latch tab from its retaining relationship to the spout and the spout plug from the end of the spout, which causes the kicker lever to urge the spout toward its open position. Such action raises the end of the spout above the upper rim of the cap housing wall whereby it may be conveniently grasped and pivoted to its fully open position.

In some circumstances, it is desirable to allow any contents in the spout passage to drain back into the container when the spout is closed. To facilitate such draining, the spout is formed to a length which will allow it to be positioned at an angle above horizontal when closed and the container is in an upright position. Additionally, the end of the spout is cut at a complementary angle to the closed angle of the spout so that the angled end of the spout engages the latch wall flushly.

In a variation of the preferred folding spout cap, an inner throat seal or pinch seal may be provided at the inner end of the spout passage. A bead or bump is provided at the throat or inner end of the spout passage and is positioned to be engaged by portions of the bellows when the spout is folded closed to pinch off the spout passage and seal the contents within the container. The pinch sealing embodiment is useful for containers holding relatively thin liquids which tend to drain back into the container as soon as the container is placed upright or by the aid of suction when external pressure is released from a squeeze container.

In a further variation of the folding spout embodiment, opening the spout is complicated to a degree to make the cap somewhat child resistant. The kicker latch wall is not scored to stiffen it, so that it resists being pivoted outward and tends to snap back to its upright position. The end of the spout is provided with a V-shaped notch intersecting the outlet of the spout passage, and the end of the latch tab has a complementary shape. When the kicker latch is pivoted outward a small but sufficient distance, the kicker lever urges the spout upward, where the end is caught by the latch tab. The end of the latch tab is sized to seal the outlet of the spout passage. To fully open the spout, the spout must be grasped by the fingers of one hand while a finger of the other hand pivots the kicker latch outward far enough to release the end of the spout from the latch tab. The sides of the spout are provided with grip beads to facilitate grasping the spout. Thus, the two-handed folding spout cap has a sealed intermediate position between fully closed and fully open.

The kicker latch of the present invention is applicable to types of caps for squeeze and squirt containers other than of the folding spout type. In one representative type, a top wall closes a cylindrical side wall and has a short stub spout extending upward therefrom. A lid or closure is hinged to the cap and has a spout plug on an inside surface thereof which is positioned to be received in the spout when the lid is folded into covering relation to the top wall. In the present invention, a kicker latch is positioned in a recess of the cap, is hinged to the cylindrical side wall, and has a latch tab and a kicker lever extending inwardly therefrom. The latch tab is positioned to retain the lid in the closed position. The kicker lever is positioned to engage a lower surface of the lid whereby pivoting the kicker latch outward urges the lid away from its closed position to facilitate gripping an edge of the lid to pivot it to a fully open position.

The kicker latch is also applicable to captive caps for a number of types of containers for pills and granulates wherein a wide opening in the cap is desired. Such caps are formed as one-piece members with lids integrally hinged to a cap body. The kicker latch is applied to such caps in much the same manner as for the nonfolding spout caps for squeeze containers described above.

A full opening, captive closure type of cap with child resistant features includes a cylindrical wall with an upwardly extending rim which receives a hinged closure or lid entirely within it. An inner peripheral shoulder receives a cylindrical seal formed on an inner surface of the lid. The outer surface of the lid, opposite the hinge is notched. A kicker latch is integrally hinged to the main cap wall and is positioned in a recess above the kicker latch hinge. The kicker latch has a latch tab at its outer end which fits into the notch in the lid. A kicker lever engages an inner surface of the lid on the opposite side of the notch. A rim notch is cut into the rim of the cap wall at a position spaced circumferentially from the kicker latch, and a lift tab extends radially from the lid through the rim notch. When the kicker latch is pivoted outward, the lid is lifted enough to provide fingernail access under the lift tab. However, the cylindrical seal still engages the inner peripheral shoulder, sealing the container, until the lift tab is grasped and the lid is pivoted to its open position.

The kicker latch of the present invention is applicable for use with containers, other than bottles and vials, in which the container is a lid which is completely separable from the container, such as bottles, jars, and the like. With such containers, it may be desirable to provide at least two kicker latches, on opposite sides of the container. In an exemplary embodiment, a rectangular box container has a cooperating lid with a lower rim which is received within the upper edges of the walls of the box container. At each end of the lid, a notch is formed in the top surface and in the end surface to form a recessed abutment with an upper and a lower surface. Each end of the box container has a kicker latch integrally hinged thereto and positioned for engagement of a latch tab with the upper surface of the abutment and a kicker lever with the lower surface of the abutment. When at least one of the kicker latches is pivoted outwardly, the kicker lever raises the end of the lid engaged thereby to facilitate grasping the lid to remove same. Alternatively, both kicker latches can be operated simultaneously.

OBJECTS AND ADVANTAGES OF THE INVENTION

The principal objects of the present invention are: to provide an improved type of closure for containers which facilitates opening and closing thereof; to provide such a closure cap including a kicker latch member including a kicker lever which engages a closure member and which urges the closure member away from its closed position when the kicker latch is pivoted away from the cap; to provide such a cap wherein the kicker latch includes a latch tab extending therefrom which retains the closure member in its closed position; to provide, particularly, a folding spout type of cap including a kicker latch which urges the spout upwardly toward an open position to facilitate grasping the spout when the kicker latch is pivoted away from the spout; to provide such a folding spout cap which may incorporate an internal seal at a throat of the spout which closes when the spout is folded toward its closed position; to provide such a folding spout cap wherein a spout end plug is positioned on the kicker latch to engage the end of the spout and close the spout passage when the spout is folded to its closed position; to provide such a folding spout cap wherein folding the spout to its closed position pivots the kicker latch to a latched position in which the latch tab is in a retaining position in relation to the end of the spout; to provide a modified embodiment of such a folding spout cap with child resistant features; to provide such a folding spout cap wherein a latch wall of the kicker latch is stiffened and the end of the spout is latched whereby, when the kicker latch is pivoted outward, the spout is caught by the latch in a sealed intermediate position so that two hands are required to release the spout to allow grasping to fold the spout to its fully open position; to provide such folding spout caps which can be manufactured as one piece by molding; to provide a cap for a squeeze type container with a nonfolding spout which incorporates a kicker latch; to provide a large opening cap for containers of pills, granulates, and the like which incorporates the kicker latch, including caps with D-shaped openings and full circular openings; to provide such a large opening cap having child resistant features which incorporates the kicker latch to facilitate opening; to provide containers having lids which are completely separable which incorporate the kicker latch; to provide closures incorporating the kicker latch for a wide variety of types of containers; and to provide a kicker latch for container closures which is economical to manufacture, effective and convenient in operation, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 8 is an enlarged fragmentary diametric sectional view of a two-handed folding spout cap embodiment of the present invention with the spout shown in a closed position.

FIG. 9 is a view similar to FIG. 8 and shows the spout of the two-handed folding spout cap in the intermediate position.

FIG. 10 is a further enlarged cross sectional view of the spout of the two-handed folding spout cap and illustrates side beads which facilitate gripping the spout to pivot it to a fully open position.

FIG. 11 is a further enlarged fragmentary view similar to FIG. 8 and illustrates a V-shaped notch at the end of the spout which receives the end of the latch tab to seal the spout passage in the intermediate position of the spout.

FIG. 12 is an enlarged diametric cross sectional view of a squirt container cap embodiment incorporating a kicker latch according to the present invention, with the closure member thereof shown in a closed position.

FIG. 13 is a perspective view of the squirt container cap with a closure member shown in a fully open position and with the kicker latch shown pivoted outward.

FIG. 14 is an enlarged diametric cross sectional view of a wide mouth container cap embodiment for use on a container of pills or granulates which incorporates the kicker latch of the present invention, with a closure member thereof shown in an open position.

FIG. 15 is a view similar to FIG. 14 and illustrates the wide mouth container cap with the closure member in its closed position.

FIG. 16 is an enlarged diametric cross sectional view of a full opening wide mouth container cap embodiment incorporating the kicker latch of the present invention with a closure member and the kicker latch shown in fully open positions in which the cap is molded.

FIG. 17 is a perspective view of the full opening wide mouth container with the closure member show in its open position.

FIG. 18 is an exploded perspective view of a box container embodiment incorporating a pair of the kicker latches of the present invention.

FIG. 19 is a somewhat enlarged longitudinal sectional view of the box container with a lid and the kicker latches shown in their closed positions.

FIG. 20 is a fragmentary view similar to FIG. 19 and illustrates one of the kicker latches in an outwardly pivoted position to urge the lid open from the container.

FIG. 21 is an enlarged perspective view of a wide mouth sealing container cap embodiment incorporating the kicker latch of the present invention and requiring two actions to open, with a closure member shown in a closed position.

FIG. 22 is a diametric cross sectional view taken on line 22—22 of FIG. 21 and illustrates internal details of the wide mouth sealing container cap.

FIG. 23 is an enlarged fragmentary view similar to FIG. 22 and illustrates details of cooperating cam surfaces of a latch tab and ledge of the wide mouth sealing container cap.

DETAILED DESCRIPTION OF THE INVENTION

Figure 1:
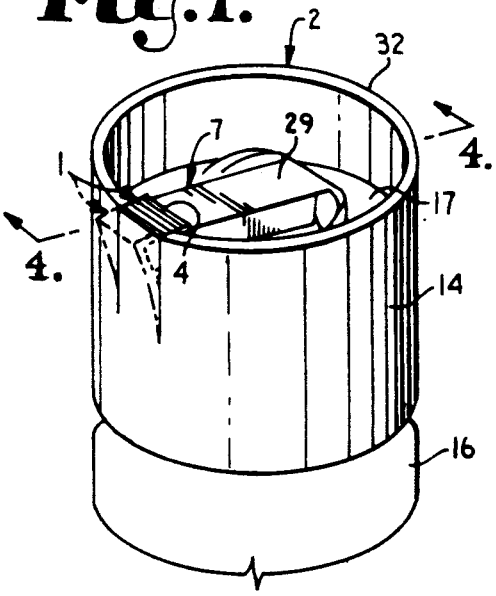
FIG. 1 is an enlarged perspective view of a folding spout cap for a container and including a kicker latch embodying the present invention, with a spout shown in a closed position and with a release position of the kicker latch shown in phantom lines.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates a kicker latch embodying the present invention which is incorporated in a folding spout type of cap 2. The kicker latch 1 includes a latch wall 3 which is hingedly connected to the cap 2. A latch tab 4 extends from an outer end 5 of the latch wall 3, and a kicker lever 6 extends from the latch wall 3 at a medial position in spaced relation to the latch tab 4. In general, the kicker latch 1 is pivoted outward from the cap 2 which causes the kicker lever 6 to be revolved to urge the closure member or spout 7 away from its closed position to facilitate grasping the spout 7 to fold it to its fully open position.

Figure 2:
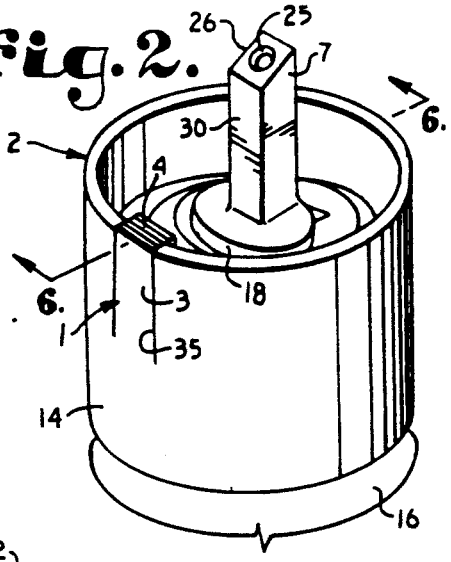
FIG. 2 is a perspective view of the folding spout cap with the spout shown in an open position.
Figure 5:
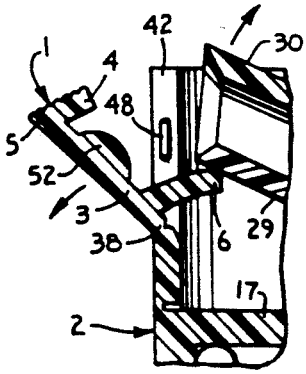
FIG. 5 is a further enlarged fragmentary view similar to FIG. 4 and shows the kicker latch being pivoted outward, causing the kicker lever to urge the spout toward its open position.
Figure 6:
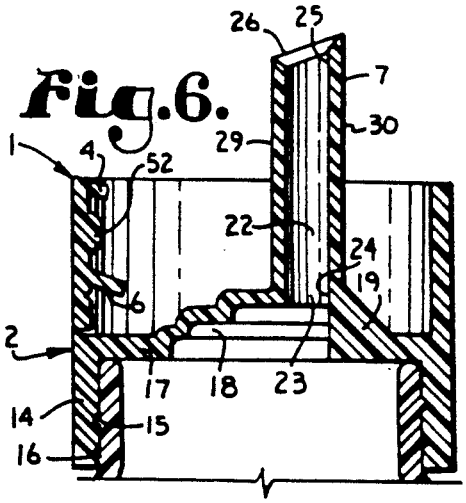
FIG. 6 is diametric cross sectional view taken on line 6—6 of FIG. 2 and illustrates the spout in a fully open position.

Referring to FIGS. 1–6, the structure and functioning of the kicker latch 1 in a general embodiment of a folding spout cap, the cap 2, is illustrated. The cap 2 is formed by a hollow cylindrical main or side wall 14 having means such as internal threads 15 formed within a lower portion of the wall 14, the threads 15 providing for attachment of the cap 2 to the neck of a container 16, such as a squeeze bottle. The wall 14 is closed at a middle axial position by a diaphragm or middle wall 17 and a bellows 18. The spout 7 connects to the bellows 18, which provides flexibility to allow the spout 7 to be folded between a closed position (FIGS. 1 and 4) and an open position (FIGS. 2 and 6). The bellows 18 and diaphragm 17 may be reinforced by a gusset 19 which additionally determines the area of flexibility between the spout 7 and the bellows 18.

The illustrated spout 7 has a square cross section and has a central passage 22 extending from a throat 23 at an inner end 24 to a mouth 25 at an outer end 26. The spout 7 has a front or inner surface 29 and a back or outer surface 30. When the spout 7 is folded to its fully closed position (FIG. 4), it is completely below an upper rim 32 of the side wall 14, making the spout 7 relatively inaccessible.

The kicker latch 1 is positioned in an opening or notch 35 formed in an upper portion of the main wall 14 of the cap and, in a closed and retaining position of the latch 1, forms a continuation of the wall 14. The latch wall 3 is connected by an integral or "living" attachment hinge 37 to the main wall 14. The latch wall 3 may be scored to form an operating or pivoting hinge 38 at a position between the kicker lever 6 and the attachment hinge 37.

Figure 3:
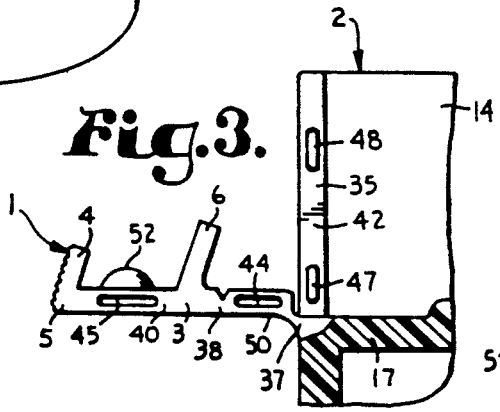
FIG. 3 is a further enlarged fragmentary cross sectional view of the folding spout cap of with the kicker latch shown in a radially extending position in which the cap is molded.

In order to control the position Of the kicker latch 1 relative to the remaining portions of the cap 2, side edges 40 of the latch wall 3 and side edges 42 forming the notch 35 in the wall 14 are provided with cooperating snap components. As illustrated in FIGS. 3 and 5, the edges 40 of the latch wall 3 are provided with inner grooves 44 and outer grooves 45, and the side edges 42 of the notch 35 are provided with respectively complementary inner beads or bumps 47 and outer beads or bumps 48.

Only the pivoting hinge 38 is required for proper operation of the kicker latch 1. However, the illustrated cap 2 can be injection molded without cores, thus more economically, if the cap 2 is molded with the kicker latch 1 in a radially outward orientation, as shown in FIG. 3. For this reason, once the inner panel 50 is initially snapped into place within the notch 35, there is no functional reason to snap it out. Therefore, it is desirable for the inner snap components 44 and 47 to be relatively tight fitting. Conversely, it is desirable for the snap components 45 and 48 to be somewhat looser fitting for convenience in operation of the kicker latch 1 to open the cap 2. The operating hinge 38 and outer snap components 45 and 48 may be configured to control the position of the outer portion of the kicker latch 1 in its open and nonretaining position such that when the spout 7 is folded to the closed position, engagement of the inner surface 29 of the spout 7 with the kicker lever 6 of the latch 1 pivots the kicker latch 1 to its closed and retaining position. For such operation, it is desirable for the outer snap components 45 and 48 to be relatively loose and for the operating hinge 38 to be stiffened somewhat so that the kicker latch 1 resiliently pivots back toward its closed position when released. The snap components 45 and 48 prevent the kicker latch 1 from pivoting to the fully closed position and position the kicker lever 6 to be engaged by the spout 7 when folded to its closed position.

Since the cap 2 is principally intended for use on a container 16 of liquid or semi-liquid material, it is necessary for the cap 2 to completely seal the container 16 when the spout 7 is folded to its closed position. FIGS. 3–6 illustrate a spout seal plug 52 on an inner surface of the latch wall 3 between the latch tab 4 and the kicker lever 6 which is positioned for reception in the passage mouth 25 at the outer end 26 of the spout 7 to seal the spout passage 22 when the spout 7 is in the closed position. Alternatively, or in addition, a pinch seal can be formed at the passage throat 23 by means such as a seal boss 54 (FIG. 7) which is positioned at the throat 23 for sealing engagement by a fold 56 of the bellows 18 when the spout 7 is folded to the closed position.

Figure 4:
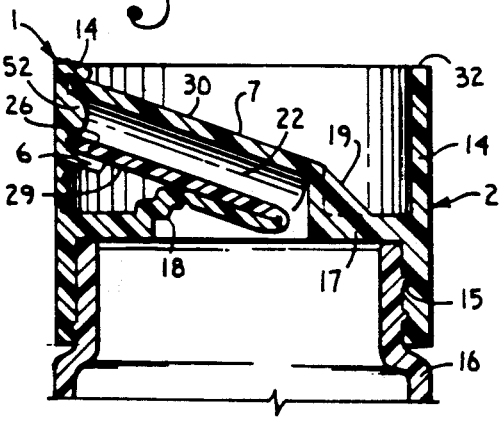
FIG. 4 is an enlarged diametric sectional view of the folding spout cap taken on line 4—4 of FIG. 1 and shows the spout in a closed position.
Figure 7:
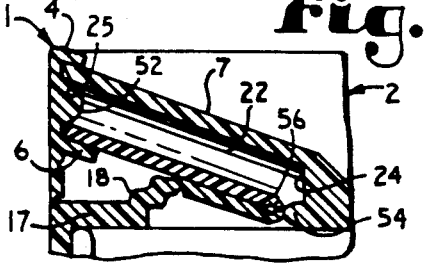
FIG. 7 is a fragmentary sectional view illustrating an inner sealing embodiment of the folding spout cap incorporating the kicker latch of the present invention.

As illustrated particularly in FIG. 4, the spout 7 is at an angle above horizontal when in the closed position. The outer end 26 of the spout 7 is angled in a complementary manner to the angle of the spout 7 in its closed position so that the end 26 is flush with the latch wall 3. The purpose for the angular closure and the use of the end seal plug 52 is to allow relatively viscous liquids or semi-liquids remaining in the spout passage 22 to drain back into the container 16 when the spout 7 is closed and the container 16 placed in an upright position, to avoid clogging the spout passage 22. The inner pinch seal formed by the seal boss 54 shown in FIG. 7 is more appropriate for use with containers of relatively thin liquids which tend to quickly drain out of the spout passage 22 with the spout 7 in a fully open position or upon the release of external pressure from the squeeze container 16. Thus, it is unlikely that a low viscosity liquid will remain in the spout passage 22 and clog it. In fact, the cap 2 may be configured so that the spout 7 is at a nearly horizontal orientation in the closed position for use with containers 16 of low viscosity liquids.

FIGS. 8–11 illustrate a two-handed embodiment of a folding spout cap 60 incorporating a kicker latch 61 according to the present invention. The cap 60 is similar in many respects to the cap 2, but incorporates child resistant features which make the cap 60 more difficult to operate for small children. The cap 60 includes a hollow cylindrical main wall 63 having threads 64 or other means for attachment of the cap 60 to a container 65, such as a bottle or squeeze container. A transverse diaphragm 67 extends across the main wall 63, and a bellows 68 flexibly connects a spout 69 to the diaphragm 67. The kicker latch 61 has a latch wall 72 connected by an integral attachment hinge 73 to the main wall 63.

The main wall 63 and the latch wall 72 have snap components 75 at an inner end of the latch wall 72 and at the inner ends of side edges forming a notch (not shown) similar to the notch 35 of the cap 2. The snap components 75 are tight fitting, such that once snapped into an upright position, as viewed in FIGS. 8 and 9, the latch wall 72 is intended to stay in the upright position. The cap 60 is preferably formed by injection molding with the latch tab 61 in a radially outward position, in a manner similar to that shown for the cap 2 in FIG. 3. The latch wall 72 is stiffly flexible and resilient, and does not incorporate an operating hinge similar to the hinge 38 of the cap 2.

A latch tab 77 extends inwardly from the outer end of the latch wall 72, and a kicker lever 79 extends inwardly from a position on the latch wall 72 spaced from the latch tab 77. A spout end plug 81 is positioned on the latch wall 72 between the latch tab 77 and the kicker lever 79 and is provided for plugging the outer end of a spout passage 82 in the fully closed position shown in FIG. 8. Alternatively, the spout passage 82 may be sealed in the closed position by other means, such as a pinch type seal similar to that shown in FIG. 7. The illustrated spout 69 is oriented nearly horizontally in the fully closed position shown in FIG. 8. However, the cap 60 can also be configured for the spout 69 to be at an angle above horizontal in the closed position, in a manner similar to the spout 7 of the cap 1 shown in FIG. 4.

The kicker latch 61 and the spout 69 are configured so that when the top end of the kicker latch 61 is pivoted away from the spout 69, the kicker lever 79 urges the spout 69 upward where it is caught in an intermediate position between fully closed and fully open by an end 84 of the latch tab 77 when the kicker latch 61 is released. The end 84 of the latch tab 77 is doubly beveled, and the outer end 86 of the spout 69 has a V-shaped notch 87 (FIG. 11) formed thereacross, the notch 87 being sized and shaped to receive the end 84 of the latch tab 77 therein. The end 84 of the latch tab 77 is somewhat larger than the notch 87, and the notch 87 intersects the spout passage 82, whereby the latch tab end 84 seals the spout passage 82 when the latch tab end 84 engages the notch 87. In the intermediate position, it is necessary to pivot the kicker latch 61 away from the spout 69 to release the latch tab end 84 from the notch 87 to thereby release the spout 69 for grasping to pivot it to a fully open position. Generally, it requires the fingers of both hands to pivot the kicker latch 61 and grasp the spout 69, thereby complicating the opening procedure for children. However, the cap 60 is reasonably convenient for adults to open. To facilitate grasping the spout 69, the sides of the illustrated spout 69 are provided with elongated beads 89 (FIGS. 10 and 11).

FIGS. 12 and 13 illustrate a cap 90 having a nonfolding stub spout 91 and incorporating a kicker latch 92 to facilitate opening a hinged cover or closure member 93 which seals the spout 91. The cap 90 is formed by a hollow cylindrical main wall 96 which is closed by a top wall 97 having the spout 91 formed thereon, the spout 91 having a spout passage 98 formed therethrough. The inner surface of the main wall 96 has threads 99 or other means for attachment of the cap 90 to a container (not shown), such as a bottle or squeeze container. In the illustrated cap 90, the cover 93 is connected to the top wall 97 by an integral hinge 100. A spout passage plug 102 is formed on the inner side of the cover 93 and is positioned to be sealingly received in the top end of the spout passage 98 in the closed position of the cover 93, as shown in FIG. 12.

The kicker latch 92 includes a latch wall 105 which is connected by an integral hinge 106 to the main wall 96 at a recess 107 formed into the main wall 96 opposite the cover hinge 100, near the intersection of the main wall 96 with the top wall 97. A latch tab 110 extends from an outer end of the latch wall 105, and a kicker lever 111 extends from the latch wall 105 in spaced relation to the latch tab 110. A notch 112 is formed in the cover 93 to receive the latch tab 110 in the closed position of the cover 93.

When the kicker latch 92 is pivoted away from the cover 93 a sufficient distance, the kicker lever 111 urges the cover 93 away from its closed position. Because of relatively tight fitting between parts of the kicker latch 92 and the cover 93 in the illustrated cap 90, some flexure of the latch wall 105 between the latch tab 110 and the kicker lever 111 is necessary before the latch tab 110 is drawn away for enough to release a catch portion 114 of the cover 93. This results in a tendency of the cover 93 to be snapped open abruptly. To close and retain the cover 93, the kicker latch 92 and the cover 93 are pivoted toward their respective closed positions until the catch portion 114 is nearly caught beneath the latch tab 110. At this point, the cover 93 and kicker latch 92 may be snapped into their fully closed positions.

FIGS. 14 and 15 illustrate a wide mouth cap 115 with a partially restricted opening or mouth 116, and FIGS. 16 and 17 illustrate a wide mouth cap 117 with an unrestricted opening or mouth 118. The caps 115 and 117 are appropriate for use with containers (not shown) for dispensing dry or nonliquid materials, such as pills, tablets, granulates, powders, and the like. The open mouths 116 and 118 of the caps 115 and 117 allow such materials to be poured therethrough and, in the case of granulates or powders, the entry of a utensil such as a spoon, to obtain a quantity of the materials therein. The cap 115 has a closure member 119 and a kicker latch 120, and the cap 117 has a closure member 123 and a kicker latch 124.

Referring to FIGS. 14 and 15, the cap 115 is formed by a hollow cylindrical main wall 127 which is closed at a top end by the closure member 119 and a chordal segment top wall 128. The closure member 119 is connected to the top wall 128 by an integral hinge 129. The kicker latch 120 includes a latch wall 130 connected by an integral hinge 131 to the main wall 127. A latch tab 132 extends from an outer end of the latch wall 130, and a kicker lever 133 extends from the latch wall 130 at a medial position therealong. The cap 115 has a seal groove 136 extending along a shoulder in the mouth 116 thereof, and the closure member 119 has a seal bead 137 extending along its periphery which is sized, shaped, and positioned to be received in the seal groove 136 in the closed position of the closure member 119 to seal a container having the cap 115 thereon. The illustrated cap 115 has threads 138 formed on the inner surface of the main wall 127 for attachment of the cap 115 to a container.

In the closed position of the closure member 119, the latch tab 132 engages the upper side of a ledge 139 which is formed on the periphery of the closure member 119 opposite the hinge 129. The kicker latch 120 is positioned in an internally closed recess 141 formed into the main wall 127 of the cap 115. Pivoting the kicker latch 120 away from the closure member 119 engages the kicker lever 133 with the under side of the ledge 139 which urges the closure member out of its closed position.

Referring to FIGS. 16 and 17, the cap 117 is formed by a hollow cylindrical main wall 144 and has the closure member 123 connected thereto by an integral hinge 145. Threads 147 are formed on an inside surface of the main wall 144 for attachment of the cap 117 to a container. The closure member 123 has a depending peripheral sealing rim 149 which is sized to be sealingly received within the mouth 118 of the cap 117 at the upper end of the main wall 144. A notch 150 is formed in the closure member 123 opposite the hinge 145 and provides a latching ledge 151.

The kicker latch 124 includes a latch wall 154 connected by an integral hinge 155 to the main wall 144 at a recess 156, into which the kicker latch 124 is received. A latch tab 157 extends from an end of the latch wall 154, and a kicker lever 158 extends from the latch wall 154 at a position spaced inwardly from the latch tab 157. The sides of the recess 156 and the sides (not shown) of the latch wall 154 are provided with snap components 160 so that the latch wall 154 is normally urged to an upright position by its inherent resilience. In the closed position of the closure member 123, the latch tab 157 engages the upper side of the latching ledge 151. Pivoting the kicker latch 124 away from the closure member 123 engages the kicker lever 158 with the lower side of the ledge 151 to thereby urge the closure member 123 away from its closed position with the sealing rim 149 within the mouth 118 of the cap 117.

FIGS. 18–20 illustrate a box type container 160 in which a pair of kicker latches 161 according to the present invention are incorporated. The container 160 generally includes a rectangular body 162 and a container lid 163 which is received into the body 162 to close the container 160. The container body 162 is formed by opposite side walls 165 and end walls 166 which are closed at the bottom by a bottom wall 167. A peripheral shoulder bead 168 is formed on the inner surfaces of the walls 165 and 166 at their top ends. The lid 163 is formed by a top wall 171 having opposite side walls 172 and end walls 173 depending therefrom. Additionally, a peripheral rim 174 depends from the walls 172 and 173, the rim 174 being sized to be received within a container mouth formed by the upper ends of the walls 165 and 166 and the shoulder bead 168. The end walls 173 of the lid 163 have retainer ledges 177 formed within insets 178 thereof. The ledges 177 cooperate with the kicker latches 161 to retain the lid 163 on the container 162 and to raise the lid 163 to allow more convenient grasping to remove the lid 163 from the container 162.

Each of the kicker latches 161 includes a latch wall 180 connected by an integral hinge 181 to a respective end wall 166 of the container 162 at a recess 182 formed therein. A latch tab 183 extends from an upper end of the latch wall 180, and a kicker lever 184 extends from the latch wall 180 at a position between the latch tab 183 and the hinge 181. Pivoting either of the kicker latches 161 outward withdraws the latch tab 183 from its retention position relative to the ledge 177 of the lid 163 and engages the kicker lever 184 with the lower surface of the ledge 177 to thereby urge the lid 163 upward from its closed position, as illustrated in FIG. 20, to facilitate gripping the lid 163 to remove it from the container 162. It is also possible, and probably advisable, to operate both kicker latches 161 simultaneously to balance the lifting of the lid 163.

FIGS. 21–23 illustrate a wide mouth cap 190 having features which render the cap 190 at least somewhat child resistant. The cap 190 generally includes a cap body 191 having a closure member or lid 192 connected thereto by an integral hinge 193. The illustrated cap 191 has a circumferential groove 194 formed within the cap body 191 for snap-on attachment to a container 195, such as a bottle. In child resistant caps, permanent snap-on caps are often preferred since the contents of the container cannot be accessed by twisting off the cap. Thus, other means must be provided for accessing the contents, which are difficult for small children to operate, but which can be conveniently opened by an adult who can read the opening instructions. A kicker latch 196 is connected to the cap body 191 by an integral latch hinge 197 to facilitate opening the lid 192.

The lid 192 is formed by a top wall 201 having a cylindrical seal wall 202 depending from an inner surface of the top wall 201. The seal wall 202 is sized to be sealingly received within a cylindrical seal opening or mouth 203 formed at the upper end of the cap body 191. The cap body 191 has an upstanding security rim 205 which is sized to receive the lid 192 flushly therein (FIG. 21). Only a hinge extension 206, a lift tab 207, and the kicker latch 196 extend through the rim 205. The kicker latch 196 is formed by a latch wall 210 having a latch tab 211 and a kicker lever 212 extending inwardly therefrom. The latch wall 210 is connected by the latch hinge 197 to the cap body 191. A kicker latch recess 213 is formed in the cap body 191 opposite the hinge 193 to accommodate the kicker latch 196. A latch ledge 214 extends from the top wall 201 of the lid 192 for engagement by the latch tab 211 and the kicker lever 212.

With the lid 192 and the kicker latch 196 in their closed positions, the security rim 205 makes grasping the lid 192 very difficult. Only the lift tab 207 presents a means of grasping any part of the lid 192. However, engagement between the latch tab 211 and the ledge 214 prevents opening the lid 192. In order to open the lid 192, the kicker latch 196 must be pivoted outward to release the ledge 214 from the latch tab 211 and to engage the kicker lever 212 with the lower side of the ledge 214. Such action pivots the lid 192 open a small angle which provides a small space below the lift tab 207 to facilitate gripping it to open the lid 192.

The latch wall 210 is preferably stiff enough that it tends to be resiliently urged to its upright position. The latch wall 210 and the surfaces of the recess 213 may be provided with snap components 216 to position and retain the latch wall 210 in the upright position after molding in a radially outward position. The latch tab 211 and the ledge 214 may be provided with cooperating cam surfaces 218 and 219 respectively. The cam surfaces 218 and 219 are provided so that if the kicker latch 196 is released before the lid 192 is opened further using the lift tab 207, engagement of the cam surfaces 218 and 219 will allow the stiff resilience of the latch wall 210 to urge the lid 192 back to its closed position. Thus, to open the lid 192, it is necessary to pivot the kicker latch 196 outward and to simultaneously hold it in the outward pivoted position while grasping the lift tab 207 to pivot the lid 192 far enough away from the mouth 203 of the cap 190 to clear the ledge 214 past the latch tab 211. To close the lid 192, the lid 192 is pivoted to reseat the seal wall 202 within the mouth 203, allowing the ledge 214 to snap past the latch tab 211. The cap 190 is complex enough to open to discourage a small child, but convenient enough to open by an adult using the proper procedure.

It is to be understood that while certain forms of the present invention have been illustrated and described herein, it is not to be limited to the specific forms or arrangement of parts described and shown.

What is claimed and desired to be secured by Letters Patent is as follows:

1. In a container including a closure member adapted to close said container in a closed position of said closure member, said closure member in said closed position having an outer surface facing away from said container and an inner surface facing toward said container, the improvement comprising:

(a) a kicker latch including a latch wall connected to means on said container to enable pivotal movement of said kicker latch relative to said container;

(b) a latch tab extending from said latch wall toward said closure member and positioned to engage said outer surface of said closure member in said closed position to retain said closure member in said closed position;

(c) a kicker lever extending from said latch wall toward said closure member in spaced relation to said latch tab and positioned to engage said inner surface of said closure member in said closed position; and (d) said kicker latch, upon being pivoted away from said closure member, withdrawing said latch tab from retaining said closure member in said closed position and revolving said kicker lever to urge said closure member away from said closed position.

2. A container as set forth in claim 1 wherein said closure member is a spout connected to means on said container to enable movement between an open position and said closed position, said spout having a spout passage formed therethrough and having an outer end, and said latch including:

(a) spout plug means formed on said latch wall between said latch tab and said kicker lever, said plug means being sized and positioned to close said spout passage at said outer end in said closed position of said spout.

3. A container as set forth in claim 2 wherein:

(a) said spout is elongated and has opposite sides; and (b) grip beads are formed along said opposite sides of said spout and facilitate gripping said spout to move same to said open position.

4. A container as set forth in claim 1 wherein said closure member is a spout connected to means on said container to enable movement between an open position and said closed position, said spout having a spout passage formed therethrough and having an inner end, and including:

(a) inner seal means positioned at said inner end of said spout, said inner seal means closing said spout passage at said inner end upon said spout being placed in said closed position.

5. A container as set forth in claim 1 wherein:

(a) said container includes means forming a peripheral wall;

(b) an opening is formed in said peripheral wall and defined by opening edges;

(c) said kicker latch is positioned in said opening;

(d) said latch wall has latch edges facing toward said opening edges; and (e) snap means are formed on at least one of said opening edges and said latch edges, said snap means retaining said kicker latch in a position to retain said closure member in said closed position thereof.

6. A container as set forth in claim 1 wherein:

(a) said container closure member is a container lid which is separable from said container; and (b) said container has opposite sides; said kicker latch is a first kicker latch and including a second kicker latch; one of said kicker latches being positioned on each of said opposite sides respectively to engage said lid and retain said lid in said closed position.

7. A container cap comprising:

(a) a cap housing including container engaging means to engage said cap housing with a container;

(b) a closure member connected to said cap housing and movable between an open position enabling access to contents of a container with which said housing is engaged and a closed position preventing access to said contents, said closure member having an outer surface facing away from said housing in said closed position and an inner surface facing generally toward said housing in said closed position;

(c) a kicker latch including a latch wall connected to said housing to enable pivotal movement of said kicker latch relative to said housing;

(d) a latch tab extending from said latch wall toward said closure member and positioned to engage said outer surface of said closure member in said closed position to retain said closure member in said closed position;

(e) a kicker lever extending from said latch wall toward said closure member in spaced relation to said latch tab and positioned to engage said inner surface of said closure member in said closed position; and (f) said kicker latch, upon being pivoted away from said closure member, withdrawing said latch tab from retaining said closure member in said closed position and revolving said kicker lever to urge said closure member away from said closed position.

8. A cap as set forth in claim 7 wherein:

(a) said kicker latch and said kicker lever are so configured and positioned that said kicker latch remains in an outwardly pivoted position after said closure member is opened thereby and said kicker lever is engaged by said closure member upon pivoting said closure member to said closed position whereby said kicker latch is pivoted toward said cap to position said latch tab in a position retaining said closure member in said closed position.

9. A cap as set forth in claim 7 wherein:

(a) said cap is formed as a single piece by molding.

10. A cap as set forth in claim 7 wherein:

(a) said cap is formed as a single piece by coreless injection molding.

11. A cap as set forth in claim 7 wherein said closure member includes:

(a) a spout connected to said housing to enable movement between said open position and said closed position.

12. A cap as set forth in claim 11 wherein:

(a) said kicker latch and said spout are so adapted that said spout is in a downwardly angled orientation from outer end to inner end in said closed position with said cap in an upright position whereby any liquid within said spout is urged to drain therefrom in said closed position.

13. A cap as set forth in claim 11 wherein:

(a) said kicker latch is resiliently urged toward said closure member;

(b) said spout has catch means formed in an outer end thereof whereby, upon pivoting said kicker latch away from said cap, said spout is urged away from said closed position and said kicker latch is resiliently urged to cause said latch tab to engage said catch means and retain said spout in an intermediate position between closed and open; and (c) said kicker latch is pivoted farther away from said cap to release said latch tab from said catch means and said spout is grasped to move said spout to a fully open position.

14. A cap as set forth in claim 13 wherein:

(a) said latch tab and said catch means cooperate to seal said spout in said intermediate position.

15. A cap as set forth in claim 7 wherein said closure member is a spout connected to said housing to enable movement between said open position and said closed position, said spout having a spout passage formed therethrough and having an outer end, and said latch including:

(a) spout plug means formed on said latch wall between said latch tab and said kicker lever, said plug means being sized and positioned to close said spout passage in said closed position of said spout.

16. A cap as set forth in claim 15 and including:

(a) inner seal means positioned at an inner end of said spout opposite from said outer end, said inner seal means closing said spout passage at said inner end upon said spout being placed in said closed position.

17. A cap as set forth in claim 15 wherein:

(a) said spout is elongated and has opposite sides; and (b) grip beads are formed along said opposite sides of said spout and facilitate gripping said spout to move same to said open position.

18. A cap as set forth in claim 7 wherein:

(a) said housing includes means forming a peripheral wall;

(b) an opening is formed in said peripheral wall and defined by opening edges;

(c) said kicker latch is positioned in said opening;

(d) said latch wall has latch edges facing toward said opening edges; and (e) snap means are formed on at least one of said opening edges and said latch edges, said snap means retaining said kicker latch in a position to retain said closure member in said closed position thereof.

19. A cap as set forth in claim 7 wherein:

(a) said cap includes a depending cylindrical wall having a cylindrical axis and having said container engaging means formed thereon;

(b) a transverse wall closes said cylindrical wall;

(c) stub spout means extends parallel to said cylindrical axis from said transverse wall and forms spout passage means through said transverse wall;

(d) said closure member includes a lid connected to said cylindrical wall by lid hinge means whereby said lid is in covering relation to said cylindrical wall in said closed position; and (e) said kicker latch is hingedly connected to said cylindrical wall in diametric opposition to said lid hinge means.

20. A cap as set forth in claim 19 and including:

(a) spout plug means formed on a surface of said lid which faces said cylindrical wall in said closed position of said lid, said plug means being positioned to be sealingly received in an outer end of said spout passage means in said closed position of said lid.

21. A cap as set forth in claim 7 wherein:

(a) said cap housing forms a wide mouth opening; and (b) said closure member closes said opening in said closed position.

22. A cap as set forth in claim 21 and including:

(a) seal means formed on at least one of said cap housing or said closure member which fluidically seals said opening in said closed position.

23. A cap as set forth in claim 22 wherein said seal means includes:

(a) a seal groove formed on the periphery about one of said housing opening or said closure member; and (b) a seal bead formed on the periphery about the other of said housing opening or said closure member, said seal groove and said seal bead being cooperatively sized and shaped whereby said seal bead is received in said seal groove in said closed position of said closure member.

24. A cap as set forth in claim 22 wherein said seal means includes:

(a) a peripheral rim depending from an inner surface of said closure member which is sized and shaped to be sealingly received in said housing opening in said closed position of said closure member.

25. A cap as set forth in claim 21 wherein:

(a) said housing includes an upstanding security rim extending about said housing opening which is sized and shaped to receive said closure member flushly therewithin in said closed position of said closure member.

26. A cap as set forth in claim 7 wherein:

(a) said kicker latch is resiliently urged toward said closure member; and (b) said closure member and said latch tab have cooperating cam surfaces formed respectively thereon whereby, upon pivoting said kicker latch away from said closure member and urging same away from said closed position, the latch tab cam surface engages the closure member cam surface and urges said closure member back toward said closed position if said kicker latch is released prior to grasping said closure member and moving same a sufficient degree away from said closed position.

* * * * *